US006223675B1

(12) United States Patent
Watt et al.

(10) Patent No.: US 6,223,675 B1
(45) Date of Patent: May 1, 2001

(54) UNDERWATER POWER AND DATA RELAY

(75) Inventors: Andrew M. Watt, Jupiter; Allen F. Leatt, Tequesta, both of FL (US); Calum MacKinnon, Aberdeen (GB)

(73) Assignee: Coflexip, S.A., Paris (FR)

( * ) Notice: Subject to any disclaimer, the term of this patent is extended or adjusted under 35 U.S.C. 154(b) by 0 days.

(21) Appl. No.: 09/399,876

(22) Filed: Sep. 20, 1999

(51) Int. Cl.[7] ..... D63G 8/00
(52) U.S. Cl. ..... 114/312; 405/190
(58) Field of Search ..... 114/312, 321, 114/322, 330, 337; 405/188, 190, 191

(56) References Cited

U.S. PATENT DOCUMENTS

| | | | | |
|---|---|---|---|---|
| 3,099,316 | | 7/1963 | Johnson . | |
| 4,010,619 | * | 3/1977 | Hightower et al. | 405/191 |
| 4,502,407 | | 3/1985 | Stevens . | |
| 4,706,119 | | 11/1987 | Shatto, Jr. et al. . | |
| 4,721,055 | * | 1/1988 | Pado | 405/191 |
| 4,732,215 | | 3/1988 | Hopper . | |
| 5,046,895 | * | 9/1991 | Baugh | 405/188 |
| 5,235,931 | * | 8/1993 | Nadolink | 114/321 |

FOREIGN PATENT DOCUMENTS

| | | |
|---|---|---|
| 2 001 690 | 2/1979 | (GB) . |
| 2 160 156 | 12/1985 | (GB) . |
| 2 210 838 | 6/1989 | (GB) . |

OTHER PUBLICATIONS

"Autonomous Underwater Vehicles (AUVs)", http://www.ise.bc.ca/auv.html, (downloaded Aug. 31, 1999).
"Remotely Operated vehicles (ROVs)", http://www.ise.bc.ca/rov.html, (downloaded Aug. 31, 1999).
"Hybrid Wet–Mate Connectors: [writing the Next Chapter]", Dr. James Cairns, Sea Technology.
"AUVs—this is what the oil industry wants", International Ocean Systems Design, vol. 3, No. 4, pp. 12–15 (Jul./Aug. 1999).
"French group developing production umbilical AUV", Offshore, pp. 66 and 158 (Oct. 1998).

* cited by examiner

*Primary Examiner*—S. Joseph Morano
*Assistant Examiner*—Andrew Wright
(74) *Attorney, Agent, or Firm*—Akerman Senterfitt

(57) ABSTRACT

An underwater apparatus for performing subsurface operations adapted to be operated from a remote location above the surface of a body of water is disclosed. The apparatus includes a linelatch system that is made up of a tether management system connected to a flying latch vehicle by a tether. The tether management system controls the amount of free tether between itself and the flying latch vehicle. The flying latch vehicle interfaces with various underwater structures. Also disclosed are methods of transferring power and/or data between two or more underwater devices using the linelatch system of the invention.

19 Claims, 10 Drawing Sheets

UNDERWATER POWER AND DATA RELAY

CROSS-REFERENCE TO RELATED APPLICATIONS (Not Applicable).

STATEMENT REGARDING FEDERALLY SPONSORED RESEARCH OR DEVELOPMENT (Not Applicable).

FIELD OF THE INVENTION

The invention relates to the field of systems for deployment, recovery, servicing, and operation of equipment in deep water and methods for utilizing such systems. More particularly, the invention relates to devices having a tether management system and a detachable flying latch vehicle for use in deep water.

BACKGROUND OF THE INVENTION

Vehicles that operate underwater are useful for performing tasks below the sea surface in such fields as deep water salvage, the underwater telecommunications industry, the offshore petroleum industry, offshore mining, and oceanographic research. (See, e.g., U.S. Pat. Nos. 3,099,316 and 4,502,407). Conventional unmanned subsurface vehicles can be broadly classified according to how they are controlled. Autonomous underwater vehicles (AUVs) are subsurface vehicles that are not physically connected to a support platform such as a land-based platform, an offshore platform, or a sea-going vessel. In comparison, remotely operated vehicle (ROVs) are those subsea vehicles that are physically connected to a support platform.

The typical physical connection between an ROV and a support platform is referred to as an "umbilical." The umbilical is usually an armored or unarmored cable containing an electrical and/or hydraulic conduit for providing power to an ROV and a data communications conduit for transmitting signals between an ROV and a support platform. An umbilical thus provides a means for remotely controlling an ROV during underwater operation.

ROVs are commonly equipped with on-board propulsion systems, navigation systems, communication systems, video systems, lights, and mechanical manipulators so that they can move to an underwater work site and perform a particular task. For example, after being lowered to a subsurface position, a remotely-located technician or pilot can utilize an ROV's on-board navigation and communications systems to "fly" the craft to a worksite. The technician or pilot can then operate the mechanical manipulators or other tools on the ROV to perform a particular job. In this manner, ROVs can used to perform relatively complex tasks including those involved in drill support, construction support, platform cleaning and inspection, subsurface cable burial and maintenance, deep water salvage, remote tool deployment, subsurface pipeline completion, subsurface pile suction, etc. Although they are quite flexible in that they can be adapted to perform a wide variety of tasks, ROVs are also fairly expensive to operate as they require a significant amount of support, including, for example, a pilot, technicians, and a surface support platform.

ROVs and other subsurface vehicles that are connected to a surface vessel by a physical linkage are subject to heave-induced damage. Heave is the up and down motion of an object produced by waves on the surface of a body of water. Underwater vehicles physically attached to a floating surface platform therefore move in accord with the surface platform. Therefore, when an underwater vehicle is located near a fixed object such as the sea bed, a pipeline, or a wellhead, heave-induced movement can damage both the vehicle and the fixed object. To alleviate this problem, devices such as heave-induced motion compensators and tether management systems have been employed to reduce the transfer of heave to underwater vehicles.

In contrast to ROVs, while underwater, AUVs are not subject to heave-mediated damage because they are not usually physically connected to a support platform. Like ROVs, AUVs are useful for performing a variety of underwater operations. Common AUVs are essentially unmanned submarines that contain an on-board power supply, propulsion system, and a pre-programmed control system. In a typical operation, after being placed in the water from a surface platform, an AUV will carry out a pre-programmed mission, then automatically surface for recovery. In this fashion, AUVs can perform subsurface tasks without requiring constant attention from a technician. AUVs are also substantially less expensive to operate than ROVs because they do not require an umbilical connection to an attached surface support platform.

AUVs, however, have practical limitations rendering them unsuitable for certain underwater operations. For example, power in an AUV typically comes from an on-board power supply such as a battery. Because this on-board power supply has a limited capacity, tasks requiring a substantial amount of power such as cutting and drilling are not practically performed by AUVs. In addition, the amount of time that an AUV can operate underwater is limited by its on-board power supply. Thus, AUVs must surface, be recovered, and be recharged between missions-a procedure which risks damage to the AUV and mandates the expense of a recovery vessel (e.g., a boat).

Another drawback of AUVs is that, without a physical link to a surface vessel, communication between an AUV and a remote operator (e.g., a technician) is limited. For example, AUVs conventionally employ an acoustic modem for communicating with a remote operator. Because such underwater acoustic communications do not convey data as rapidly or accurately as electrical wires or fiber optics, transfer of data encoding real time video signals or real time instructions from a remote operator is not efficient given current technology. As such, AUVs are often not able to perform unanticipated tasks or jobs requiring a great deal of operator input.

Other underwater vehicles having characteristics similar to AUVs and/or ROVs are known. These vehicles also suffer drawbacks such as subjection to heave, need for expensive support, poor suitability for some applications, lack of a continuous power supply, poor communications, poor capabilities, etc. Therefore, a need exists for a device to help overcome these limitations.

SUMMARY

The present application is directed to a remotely operable underwater apparatus for interfacing with, transferring power to, and sharing data with other underwater devices. The apparatus includes a linelatch system for servicing and operating various subsurface devices such as toolskids, ROVs, AUVs, pipeline sections (spool pieces), seabed anchors, suction anchors, oil field production packages, and other equipment such as lifting frames, etc. The linelatch system includes a flying latch vehicle connected to a tether management system by a tether.

The flying latch vehicle is a highly maneuverable, remotely-operable underwater vehicle that has a connector adapted to "latch" on to or physically engage a receptor on a subsurface device. In addition to stabilizing the interaction of the flying latch vehicle and the subsurface device, the connector-receptor engagement can also be utilized to transfer power and data. In this aspect, the flying latch vehicle is therefore essentially a flying power outlet and/or a flying data modem. The flying latch vehicle is unlike conventional ROVs or other underwater vehicles in that its primary purpose is to bridge power and data between two devices, rather to perform a manual task such as switching a valve or drilling a hole.

The tether management system of the linelatch system regulates the quantity of free tether between itself and the flying latch vehicle. It thereby permits the linelatch system to switch between two different configurations: a "closed configuration" in which the tether management system physically abuts the flying latch vehicle; and an "open configuration" in which the tether management system and flying latch vehicle are separated by a length of tether. In the open configuration, slack in the tether allows the flying latch vehicle to move independently of the tether management system. Transmission of heave-induced movement between the two components is thereby removed or reduced.

The advantages of the linelatch system over conventional underwater vehicles allow it to be used in a number of ways to facilitate subsurface operations. For example, the linelatch system can be used for deploying and recovering loads to and from a subsurface location (e.g., the seabed). In comparison to the use of fixed rigging to deliver a load to the seabed, the linelatch system's ability to uncouple a load from vertical heave prevents heave-related damage from occurring to the load. Moreover, the maneuverability and remote operability of the flying latch vehicle facilitate accurate deployment, and faster and less risky recovery of subsurface loads.

The flexibility of the linelatch system allows it be used for various other undersea operations. Among these, for example, the linelatch system can be used to power and control underwater tools such as cleaners, cutters, and jetters. As another example, the linelatch system can be utilized for subsurface battery charging of underwater devices such as AUVs and battery-powered underwater tools. Further demonstrating its flexibility, the linelatch system can be used to convey power and data between a subsurface power and control module and a subsurface tool or vehicle.

According to one aspect, the invention includes a submersible system for transferring power from a subsurface power supply module to a subsurface device. The system includes a tether management system having an umbilical connector with an umbilical cable releasably attached thereto for deploying the tether management system from a surface vessel to a seabed, a jumper cable extendible from the tether management system configured for receiving power and/or data from an external subsurface module. The tether management system further includes a submersible vehicle provided as part of the tether management system and releasably docked thereto. The submersible vehicle has a tether receiving at least one of data and power from the tether management system. A transfer system is provided for selectively transferring the data and/or power to the submersible vehicle from a deployment vessel attached to the umbilical cable and from the external subsurface module.

The submersible vehicle of the invention is preferably self-propelled to move between the tether management system and a subsurface device for performing a task. The submersible vehicle has a connector which automatically engages a corresponding mating connector on the subsurface device when the submersible vehicle is propelled to a mating position adjacent to the subsurface device. According to one aspect, the connector is a power connector and about 50% and 100% of the power received by the submersible vehicle from the transfer system is transferred to the subsurface device. According to an alternative embodiment, an auxiliary onboard power supply can be integrated within either the tether management system or the submersible vehicle for powering the submersible vehicle and or tether management system.

According to another aspect of the invention, the submersible vehicle is operable for extending the jumper cable from the tether management system to the subsurface module to form a data and/or power connection between the subsurface module and the tether management system.

The submersible system also preferably includes suitable command and control circuitry and actuators for automatically remotely detaching the umbilical cable from the submersible system in response to a control command. In this regard, a shock absorber system on a lower portion of the tether management system for absorbing impact with a seabed resulting from positioning the submersible system.

According to yet another aspect, the invention can include a method for establishing a power and control connection from a subsurface power supply module to a subsurface device, comprising the steps of: deploying a tether management system to a subsea location; in response to a control command, extending a jumper cable from the tether management system to the subsurface power supply module for transferring at least one of data and power from the subsurface power supply module to the tether management system; and flying a power connector from the tether management system to the subsurface device to establish a power and/or data transfer circuit between the tether management system and the subsurface device.

The deploying step according to the method can further include the step of lowering the tether management system to the subsea location using a cable, and subsequently detaching the cable from the tether management system. According to one embodiment, the detaching step is performed before the jumper cable extending step. However, the detaching step can also be performed after the jumper cable extending step. In a preferred embodiment, the cable which is used to lower the system to a subsea location can be an umbilical cable for providing at least one of data, power and materials to the tether management system.

According to another aspect of the invention, a method is provided for deploying a submersible system and connecting the submersible system to a subsurface module. This method includes the step of deploying a submersible system to the bottom of a body of water, the submersible system having a tether management system that includes a jumper cable for receiving data, power, and/or material from the subsurface module, a submersible vehicle releasably docked to the tether management system, and a tether providing a power and/or data link between the submersible vehicle to the tether management system. The method further includes the step of undocking the submersible vehicle from the tether management system; and the step of connecting the jumper cable to the subsurface module.

The deploying step featured in this method can further include the step of lowering the submersible system with an umbilical cable from a vessel to the bottom of the body of water, and subsequently detaching the umbilical cable from the submersible system. It can also include the step of powering the submersible vehicle from a power source in the submersible system before the detaching step.

The connecting step of this method can additionally include the steps of maneuvering the submersible vehicle to the jumper cable, retrieving the jumper cable with the submersible vehicle, and maneuvering the submersible vehicle and jumper cable to the subsurface module; all occurring before the detaching step.

The method can also include the step of powering the submersible vehicle from the jumper cable before the detaching step. The connecting step of this method can further include the steps of maneuvering the submersible vehicle to the jumper cable, retrieving the cable with the submersible vehicle, and maneuvering the submersible vehicle and jumper cable to the subsurface module; all before the detaching step.

Unless otherwise defined, all technical terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents, and other references mentioned herein are incorporated by reference in their entirety. In the case of conflict, the present specification, including definitions will control. In addition, the particular embodiments discussed below are illustrative only and not intended to be limiting.

BRIEF DESCRIPTION OF THE DRAWINGS

The invention is pointed out with particularity in the appended claims. The above and further advantages of this invention may be better understood by referring to the following description taken in conjunction with the accompanying drawings, in which:

DETAILED DESCRIPTION

The invention encompasses underwater devices including a linelatch system adapted to be operated from a remote location above the surface of a body of water and utilized for servicing and/or operating various subsurface devices such as toolskids, ROVs, AUVs, pipeline sections (spool pieces), seabed anchors, suction anchors, oil field production packages, and other equipment such as lifting frames, etc. The below described preferred embodiments illustrate various adaptations of the invention. Nonetheless, from the description of these embodiments, other aspects of the invention can be readily fashioned by making slight adjustments or modifications to the components discussed below.

Figure 1A:
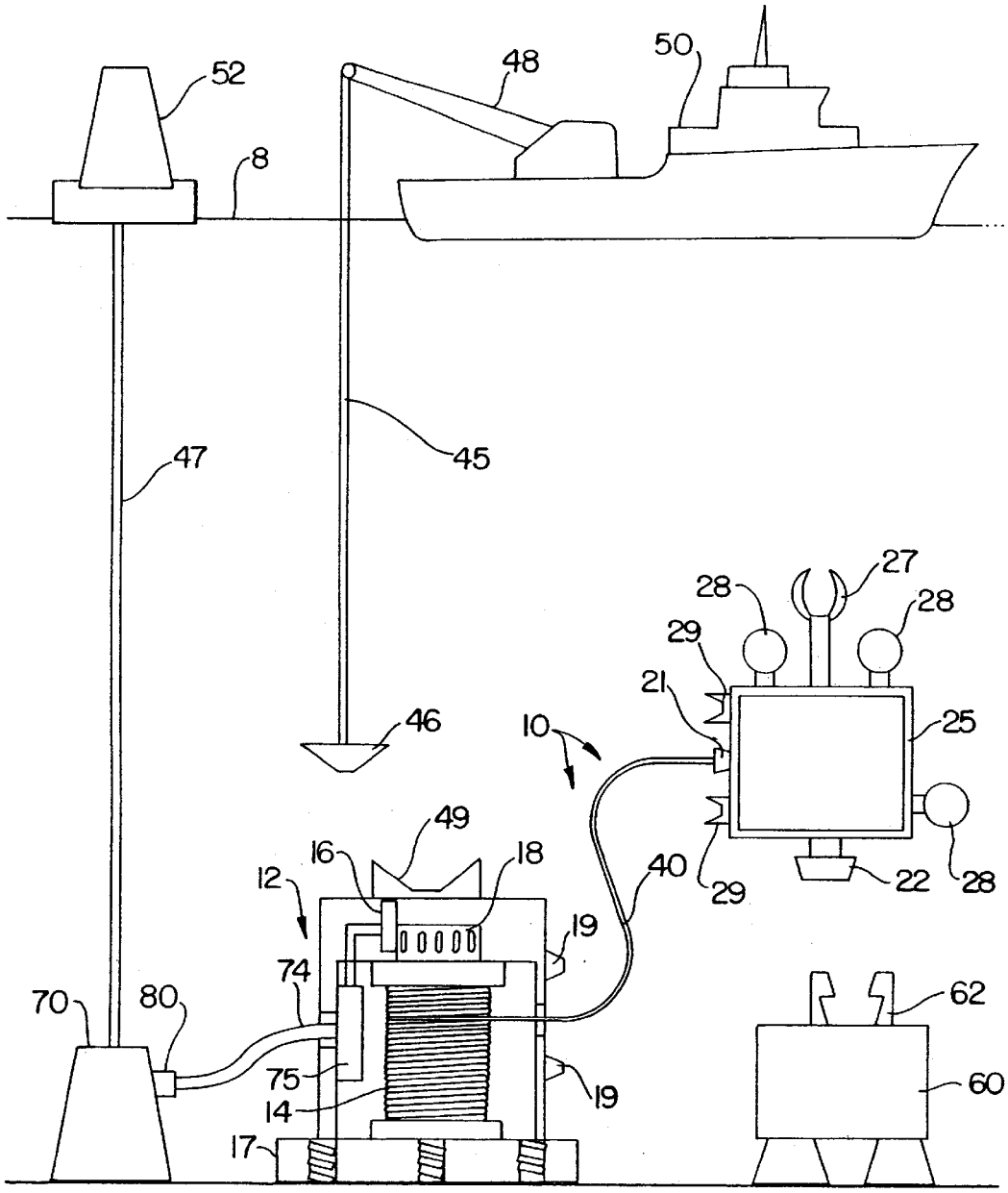
FIG. 1A is a schematic view of a linelatch system of the invention shown in the open configuration.
Figure 1B:
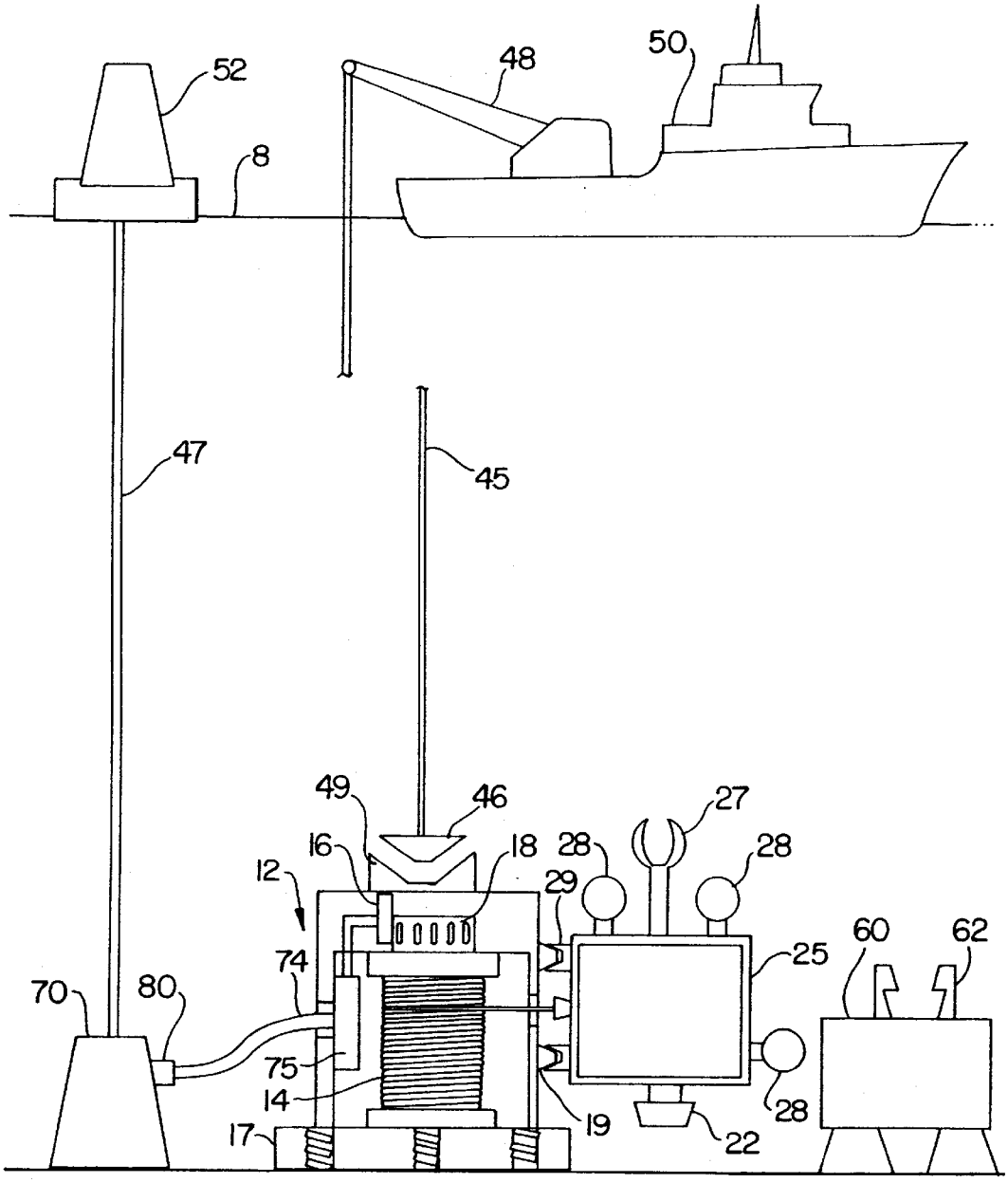
FIG. 1B is a schematic view of a linelatch system of the invention shown in the closed configuration.

Referring now to FIGS. 1A and 1B of the drawings, the presently preferred embodiment of the invention features a linelatch system 10 including a tether management system 12 connected to a flying latch vehicle 20 by a tether 40. In FIG. 1A, linelatch system 10 is shown positioned on the seabed of a body of water 8 connected to a subsurface module 70 by a jumper cable 24. From a surface support vessel 50 floating on the surface of the body of water 8 depends an umbilical 45 used to place linelatch system 10 on the seabed.

Tether management system 12 can be any device that can reel in or pay out tether 40. Tether management systems suitable for use as tether management system 12 are well known in the art and can be purchased from several sources (e.g., from Slingsby Engineering, United Kingdom; All Oceans, United Kingdom; and Perry Tritech, Inc., Jupiter, Fla.). In preferred embodiments, however, tether management system 12 includes an external frame 15 which houses a spool 14, a spool control switch 16, a spool motor 18, and jumper cable 74.

Frame 15 forms the body of tether management system 12. It can be any device that can house and/or attach system 12 components such as spool 14, spool control switch 16, and spool motor 18. For example, frame 15 can take the form of a rigid shell or skeleton-like framework. In the presently preferred embodiment, frame 15 is a metal cage. A metal cage is preferred because it moves easily through water, and also provides areas for mounting other components of tether management system 12.

Spool 14 is a component of tether management system 12 that controls the length of tether 40 dispensed from system 12. It can any device that can reel in, store, and pay out tether 40. For example, pool 14 can take the form of a winch about which tether 40 can be wound and unwound. In preferred embodiments, spool 14 is a rotatable cable drum, where rotation of the drum in one direction causes tether 40 to be payed out of tether management system 12 by unreeling it from around the drum, and rotation of the drum in the other direction causes tether 40 to be taken up by tether management system 12 by reeling it up around the drum.

Spool motor 18 provides power to operate spool 14. Spool motor 18 can be any device that is suitable for providing power to spool 14 such that spool 14 can reel in or pay out tether 40 from tether management system 12. For example, spool motor 18 can be a motor that causes spool 14 to rotate clockwise or counterclockwise to reel in or pay out tether 40. In preferred embodiments, spool motor 18 is an electrically or hydraulically-driven motor.

Spool control switch 16 is a device that controls the action of spool motor 18. It can be any type of switch which allows an operator of linelatch system 10 to control spool motor 18. In a preferred from, it is a remotely-operable electrical switch that can be controlled by a technician or pilot on surface support vessel 50 so that motor 18 can power spool 14 operation.

Tether management system 12 can also include a power and data transfer unit 75 between umbilical 45 or jumper cable 74 and tether 40. Unit 75 can be any apparatus that can convey power and data between umbilical 45 or jumper cable 74 and tether 40. In preferred embodiments of the invention, unit 75 takes the form of electrical, hydraulic and/or fiber optic lines connected at one end to umbilical 45 and/or jumper cable 74, and at the other end to tether 40. Transfer unit 75 also preferably includes suitable switching circuitry for connecting tether 40 to umbilical 45 or jumper cable 74.

Jumper cable 74 is also attached to tether management system 12. Jumper 74 is a flexible rope-like device that can be extended lengthwise from system 12 and attached to subsurface module 70 (a subsurface apparatus that can supply power and/or data) via power and data connection 80 (a power and data output socket). It can take the form of any device that can transfer power and/or data between module 70 and tether management system 12. For example, it can be a simple insulated copper wire. In preferred embodiments, however, it is a flexible waterproof cable that houses a conduit for both power (e.g., a copper electrical wire and/or a hydraulic hose) and data communication (e.g., fiber optic cables for receipt and transmission of data).

Shock absorber 17 is attached to the bottom portion of tether management system 12. It can be any device that can that can absorb or cushion the impact resulting from positioning tether management system 12 on a hard surface (e.g., the sea bed). Shock absorber 17 can, for example, be a synthetic rubber pad. In preferred embodiments, it takes the form of a plurality of springs or like compression-resisting devices encased within a rugged cover.

Detachably connectable to tether management system 12 is umbilical 45, a long cable-like device used to move linelatch system 10 between a surface platform such as surface support vessel 50 and various subsurface locations via launching and recovery device 48 (e.g., a crane or winch). Umbilical 45 can be any device that can physically connect linelatch system 10 and a surface platform. Preferably, it is long enough so that linelatch system 10 can be moved between the surface of a body of water and a subsurface location such as the sea bed. In preferred embodiments, umbilical 45 is negatively buoyant, fairly rigid, and includes an umbilical port 46 capable of transferring power and/or data between tether management system 12 and umbilical 45 (i.e. for conveyance to surface support vessel 50). In some embodiments, the umbilical port 46 includes two ports. The first port for communicating power tether management system 12 and umbilical 45. The second port for communicating data between tether management system 12 and umbilical 45. More preferably, umbilical 45 is a waterproof steel armored cable that houses a conduit for both power (e.g., a copper electrical wire and/or a hydraulic hose) and data communication (e.g., fiber optic cables for receipt and transmission of data). Umbilicals suitable for use in the invention are commercially available from several sources (e.g., NSW, Rochester, and Alcatel). An umbilical connector 49 is provided on tether management system 12 for mating with umbilical port 46.

Also attached to tether management system 12 is tether 40. It has two ends or termini, one end being securely attached to tether management system 12, the other end being securely attached to tether fastener 21 of flying latch vehicle 20. While tether 40 can be any device that can physically connect tether management system 12 and flying latch vehicle 20, it preferably takes the form of a flexible, neutrally buoyant rope-like cable that permits objects attached to it to move relatively freely. In particularly preferred embodiments, tether 40 also includes a power and data communications conduit (e.g., electricity-conducting wire, hydraulic hose, and fiber optic cable) so that power and data can be transferred through it. Tethers suitable for use in the invention are known in the art and are commercially available (e.g., Perry Tritech, Inc.; Southbay; Alcatel; NSW; and JAQUES).

Attached to the terminus of tether 40 opposite tether management system 12 is flying latch vehicle 20. Flying latch vehicle 20 is a remotely-operated underwater craft designed to mate with an undersea device for the purpose of transferring power to and/or exchanging data with the undersea device. In preferred embodiments, flying latch vehicle 20 includes tether fastener 21, chassis 25, connector 22, a manipulator 27, and propulsion system 28.

Chassis 25 is a rigid structure that forms the body and/or frame of vehicle 20. Chassis 25 can be any device to which various components of vehicle 20 can be attached. For example, chassis 25 can take the form of a metal skeleton. In preferred embodiments, chassis 25 is a hollow metal or plastic shell to which the various components of vehicle 20 are attached. In the latter form, the interior of chassis 25 can be sealed from the external environment so that components included therein can be isolated from exposure to water and pressure. In the preferred embodiment shown in FIGS. 1A and 1B, components shown affixed to or integrated with chassis 25 include tether fastener 21, connector 22, manipulator 27, propulsion system 28, and male alignment guides 19.

Tether fastener 21 connects tether 40 to flying latch vehicle 20. Tether fastener 21 can be any suitable device for attaching tether 40 to flying latch vehicle 20. For example, it can take the form of a mechanical connector adapted to be fastened to a mechanical receptor on the terminus of tether 40. In preferred embodiments, tether fastener 21 is the male or female end of bullet-type mechanical fastener (the terminus of tether 40 having the corresponding type of fastener). In other embodiments, tether fastener 21 can also be part of a magnetic or electromagnetic connection system. For embodiments within the invention that require a power and/or data conduit between tether 40 and flying latch vehicle 20, tether fastener 21 is preferably includes a tether port for conveying power and/or data between tether 40 and flying latch vehicle 20 (e.g., by means of integrated fiber optic and electrical or hydraulic connectors).

Mounted on or integrated with chassis 25 is connector 22, a structure adapted for detachably connecting receptor 62 of subsurface device 60 so that flying latch vehicle 20 can be securely but reversibly attached to device 60. Correspondingly, receptor 62 is a structure on subsurface device 60 that is detachably connectable to connector 22. Although, in preferred embodiments, connector 22 and receptor 62 usually form a mechanical coupling, they may also connect one another through any other suitable means known in the art (e.g., magnetic or electromagnetic). As most clearly illustrated in FIG. 2, in a particularly preferred embodiment connector 22 is a bullet-shaped male-type connector. This type of connector is designed to mechanically mate with a funnel-shaped receptacle such as receptor 62 shown in FIG. 2. The large diameter opening of the funnel-shaped receptor 62 depicted in FIG. 2 facilitates alignment of a bullet-shaped connector 22 during the mating process. That is, in this embodiment, if connector 22 was slightly out of alignment with receptor 62 as flying latch vehicle 20 approached subsurface device 60 for mating, the funnel of receptor 62 would automatically align the bullet-shaped portion of connector 22 so that vehicle 20's motion towards receptor 62 would automatically center connector 22 for proper engagement.

Connector 22 and receptor 62 can also take other forms so long as they are detachably connectable to each other. For example, connector 22 can take the form of a plurality of prongs arranged in an irregular pattern when receptor 62 takes the form of a plurality of sockets arranged in the same irregular pattern so that connector 22 can connect with receptor 22 in one orientation only. As another example, connector 22 can be a funnel-shaped female type receptacle where receptor 62 is a bullet-shaped male type connector. In addition to providing a mechanical coupling, in preferred embodiments, the interaction of connector 22 and receptor 62 is utilized to transfer power and data between flying latch vehicle 20 and subsurface device 60. (See below).

Figure 2:
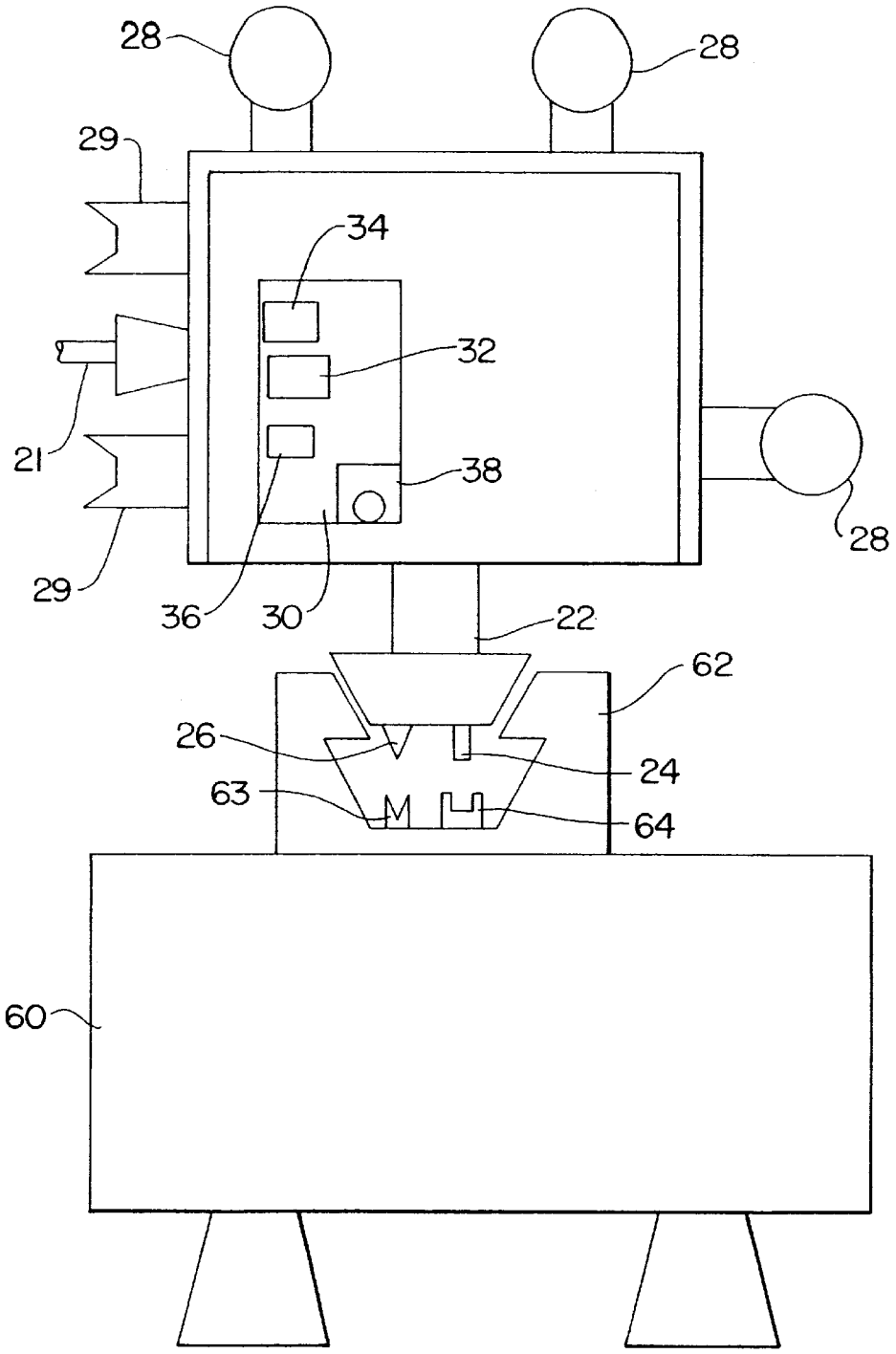
FIG. 2 is a schematic view of a flying latch vehicle of the invention.

Manipulator 27 is attached to chassis 25. In FIGS. 1A, 1B, and 2, manipulator 27 is shown as a mechanical arm for grasping subsurface objects. While it can take this form, manipulator 27 is any device that can interface with an underwater object. Preferably, manipulator 27 is adapted to grasp jumper cable 74 and insert it into power and data connection 80 on module 70.

Also attached to chassis 25 is propulsion system 28. Propulsion system 28 can be any force-producing apparatus that causes undersea movement of flying latch vehicle 20 (i.e., "flying" of vehicle 20). Preferred devices for use as propulsion system 28 are electrically or hydraulically-powered thrusters. Such devices are widely available from commercial suppliers (e.g., Hydrovision Ltd., Aberdeen, Scotland; Innerspace, Calif.; and others).

Referring now to FIG. 2, in preferred embodiments, flying latch vehicle 20 further includes an output port 24 and/or a communications port 26; and position control system 30 which may include compass 32, depth indicator 34, velocity indicator 36, and/or video camera 38.

Power output port 24 can be any device that mediates the underwater transfer of power from flying latch vehicle 20 to another underwater apparatus such as subsurface device 60. In preferred embodiments, port 24 physically engages power inlet 64 on subsurface device 60 such that power exits flying latch vehicle 20 from port 24 and enters device 60 through power inlet 64. Preferably, the power conveyed from power output port 24 to power inlet 64 is electrical current or hydraulic power (derived, e.g., from surface support vehicle 50) to subsurface device 60). In particularly preferred embodiments, power output port 24 and power inlet 64 form a "wet-mate"-type connector (i.e., an electrical, hydraulic, and/or optical connector designed for mating and demating underwater). In the embodiment shown in FIG. 2, port 24 is integrated into connector 22 and power inlet 64 is integrated with receptor 62. In other embodiments, however, port 24 is not integrated with connector 22 but attached at another location on flying latch vehicle 20, and inlet 64 is located on device 60 such that it can engage port 26 when vehicle 20 and device 60 connect.

The components of flying latch vehicle 20 can function together as a power transmitter for conveying power from tether 40 (e.g., supplied from module 70 through jumper cable 74 and tether management system 12) to an underwater apparatus such as subsurface device 60. For example, power can enter vehicle 20 from tether 40 through tether fastener 21. This power can then be conveyed from fastener 21 through a power conducting apparatus such as an electricity-conducting wire or a hydraulic hose attached to or housed within chassis 25 into power output port 24. Power output port 24 can then transfer the power to the underwater apparatus as described above. In preferred embodiments of the flying latch vehicle of the invention, the power transmitter has the capacity to transfer more than about 50% (e.g., approximately 50%, 55%, 60%, 65%, 70%, 75%, 80%, 85%, 90%, 95%, 100%) of the power provided to it from an external power source such as surface support vessel 50 (i.e., via umbilical 45 and tether 40) to subsurface device 60. Power not conveyed to subsurface device 60 from the external power source can be used to operate various components on flying latch vehicle 20 (e.g., propulsion system 28 and position control system 30). As one example, of 100 bhp of force transferred to vehicle 20 from vessel 50, 20 bhp is used by flying latch vehicle 20, and 80 bhp used by subsurface device 60.

Communications port 26 is a device that physically engages communications acceptor 63 on subsurface device 60. Port 26 and acceptor 63 mediate the transfer of data between flying latch vehicle 20 and device 60. For example, in the preferred configuration shown in FIG.2, communications port 26 is a fiber optic cable connector integrated into connector 22, and acceptor 63 is another fiber optic connector integrated with receptor 62 in on device 60. The port 26-acceptor 63 connection can also be an electrical connection (e.g., telephone wire) or other type of connection (e.g., magnetic or acoustic). In particularly preferred embodiments, the communications port 26-communications acceptor 63 connection and the power output port 24-power inlet 64 connection are integrated into one "wet-mate"-type connector. In other embodiments, communications port 26 is not integrated with connector 22 but attached at another location on flying latch vehicle 20, and acceptor 63 is located on device 60 such that it can engage port 26 when vehicle 20 and device 60 connect. Communications port 26 is preferably a two-way communications port that can mediate the transfer of data both from flying latch vehicle 20 to device 60 and from device 60 to vehicle 20.

Communications port 26 and acceptor 63 can be used to transfer information (e.g., video output, depth, current speed, location information, etc.) from subsurface device 60 to a remotely-located operator (e.g, on surface vessel 50) via linelatch 10 and umbilical 45. Similarly, port 26 and acceptor 63 can be used to transfer information (e.g., mission instructions, data for controlling the location and movement of subsurface device 60, data for controlling mechanical arms and like manipulators on subsurface device 60, etc.) between a remote location (e.g., from module 70) and subsurface device 60.

Position control system 30 is any system or compilation of components that controls underwater movement of flying latch vehicle 20, and/or provides telemetry data from vehicle 20 to a remotely-located operator. Such telemetry data can be any data that indicates the location and/or movement of flying latch vehicle 20 (e.g., depth, longitude, latitude, depth, speed, direction), and any related data such as sonar information, pattern recognition information, video output, temperature, current direction and speed, etc. Thus, position control system 30 can include such components as sonar systems, bathymetry devices, thermometers, current sensors, compass 32, depth indicator 34, velocity indicator 36, video camera 38, etc. These components may be any of those used in conventional underwater vehicles or may specifically designed for use with linelatch system 10. Suitable such components are available from several commercial sources.

The components of position control system 30 for controlling movement of flying latch vehicle 20 are preferably those that control propulsion system 28 so that vehicle 20 can be directed to move eastward, westward, northward, southward, up, down, etc. These can, for example, take the form of remotely-operated servos for controlling the direction of thrust produced by propulsion system 28. Other components for controlling movement of flying latch vehicle 20 may include buoyancy compensators for controlling the underwater depth of flying latch vehicle 20 and heave compensators (e.g., interposed between tether management system 12 and umbilical 45) for reducing wave-induced motion of flying latch vehicle 20. A remotely-positioned operator can receive output signals (e.g., telemetry data) and send instruction signals (e.g., data to control propulsion system 28) to position control system 30 through the data communication conduit included within umbilical 45 and/or jumper cable 74 (via module 70 and module pipe 47) via the data communications conduits within tether management system 12 and tether 40.

One or more of the components comprising position control system 30 can be used as a guidance system for docking flying latch vehicle 20 to subsurface device 60 or inserting jumper cable 74 into connector 80. For example, the guidance system could provide a remotely-located pilot of vehicle 20 with the aforementioned telemetry data and a video image of receptor 62 on subsurface device 60 such that the pilot could precisely control the movement of vehicle 20 into the docked position with subsurface device 60 using the components of system 30 that control movement of vehicle 20. As another example, for computer-controlled docking, the guidance system could use data such as pattern recognition data to align vehicle 20 with subsurface device 60 and the components of system 30 that control movement of vehicle 20 to automatically maneuver vehicle 20 into the docked position with subsurface device 60.

As shown in FIGS. 1A and 1B, linelatch system 10 can be configured in an open position or in a closed configuration. In FIG. 1A, linelatch system 10 is shown in the open position where tether management system 12 is separated from flying latch vehicle 20 and tether 40 is slack. In this position, to the extent of slack in tether 40, tether management system 1 2 and flying latch vehicle 20 are independently moveable from each other. In comparison, in FIG. 1B, linelatch system 10 is shown in the closed position. In this configuration, tether management system 12 physically abuts flying latch vehicle 20 and tether 40 is tautly withdrawn and mechanically locked into tether management system 12 in a docked or closed configuration. In order to prevent movement of tether management system 12 and flying latch vehicle 20 when linelatch system 10 is in the closed configuration,male alignment guides 19 can be affixed to tether management system 12 so that they interlock the female alignment guides 29 affixed to flying latch vehicle 20. Male alignment guides 19 can be any type of connector that securely engages female alignment guides 29 such that movement of system 12 is restricted with respect to vehicle 20, and vice versa.

Several other components known in the art of underwater vehicles can be included on linelatch system 10. One skilled in this art, could select these components based on the particular intended application of linelatch system 10. For example, for applications where umbilical 45 becomes detached from linelatch system 10, an on-board auxiliary power supply (e.g., batteries, fuel cells, and the like) can be included on linelatch system 10. Likewise, an acoustic modem could be included within linelatch system 10 to provide an additional communications link among, for example, linelatch system 10, attached subsurface device 60, and surface support vessel 50.

Methods of using linelatch system 10 are also within the invention. For example, as illustrated in FIGS. 3A–F, linelatch system 10 can also be used in a method for conveying power and/or data between subsurface module 70 and subsurface device 60. In preferred embodiments this method includes the steps of: deploying linelatch system 10 to the bottom of body of water 8 (i.e., the seabed), placing system 10 in the open configuration by undocking flying latch vehicle 20 from tether management system 12; and connecting jumper cable to subsurface module 70. Subsurface module 70 can be any subsurface apparatus that can provide power and/or data to another subsurface device (e.g., a manifold of a well head). Power and data can be transferred between surface platform 52 and subsurface module 70 via module pipe 47 (see FIGS. 1A and 1B).

Figure 3A:
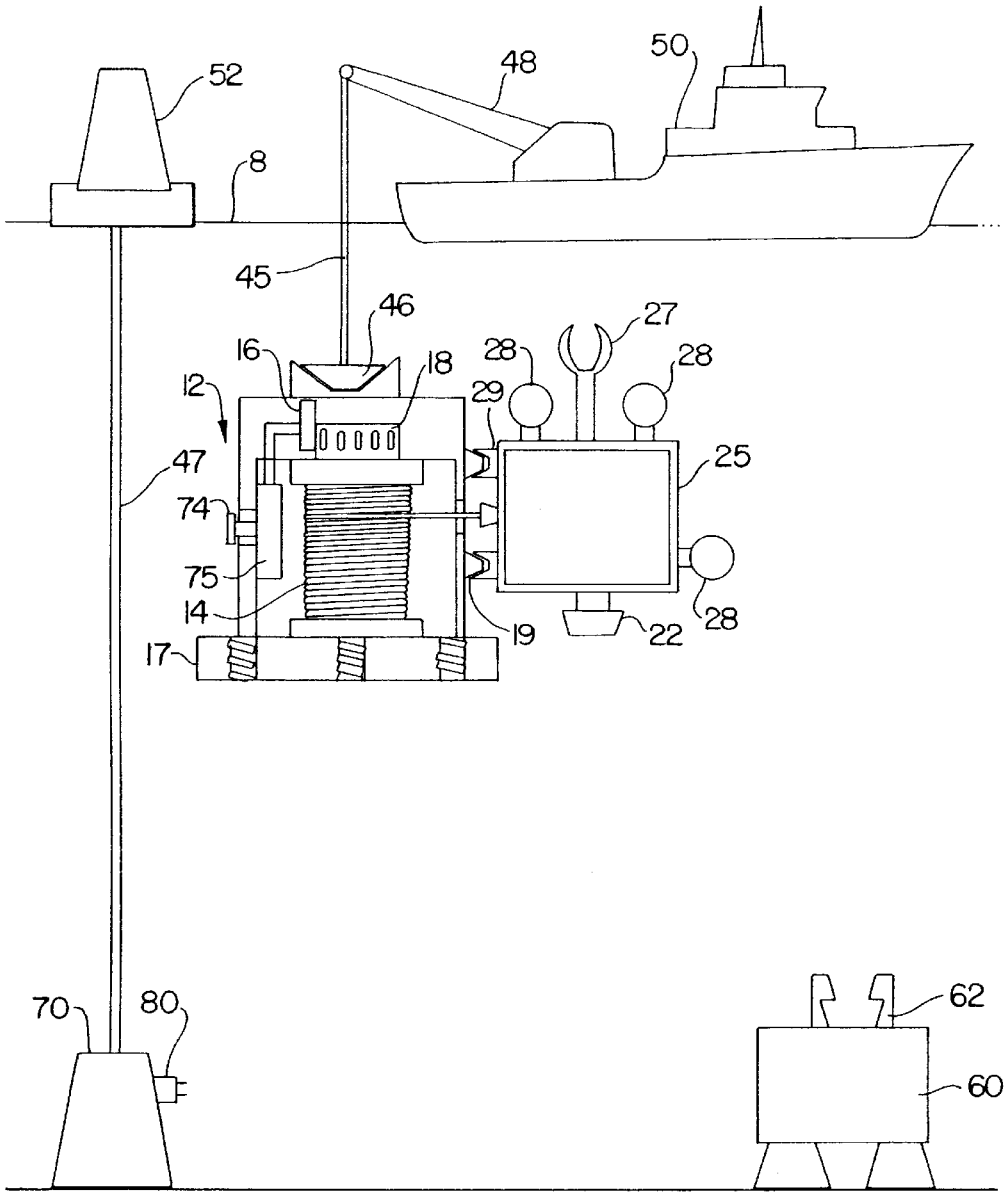
FIGS. 3A–F are schematic views showing the use of a linelatch system for providing power to an undersea device.

One example of this is illustrated in FIGS. 3A–3F. As shown in FIG.3A linelatch system 10 is deployed from vessel 50 and lowered towards the seabed by umbilical 45. System 10 can be deployed from vessel 50 by any method known in the art. For example, linelatch system 10 can be lowered into body of water 8 using a winch. Preferably, to prevent damage, linelatch system 10 is gently lowered from vessel 50 using launching and recovery device 48 (e.g., a crane) and umbilical 45.

Figure 3B:
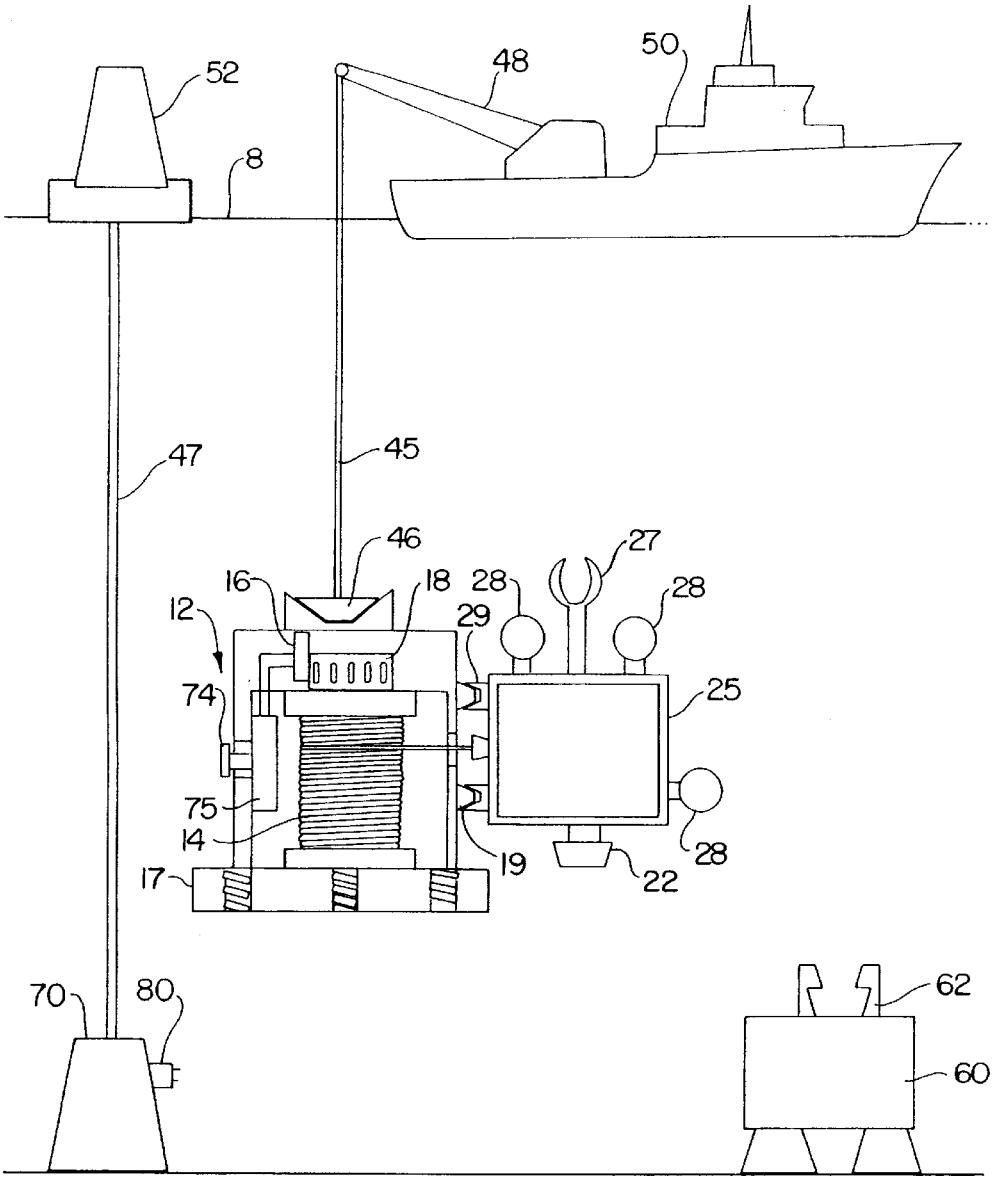
Figure 3C:
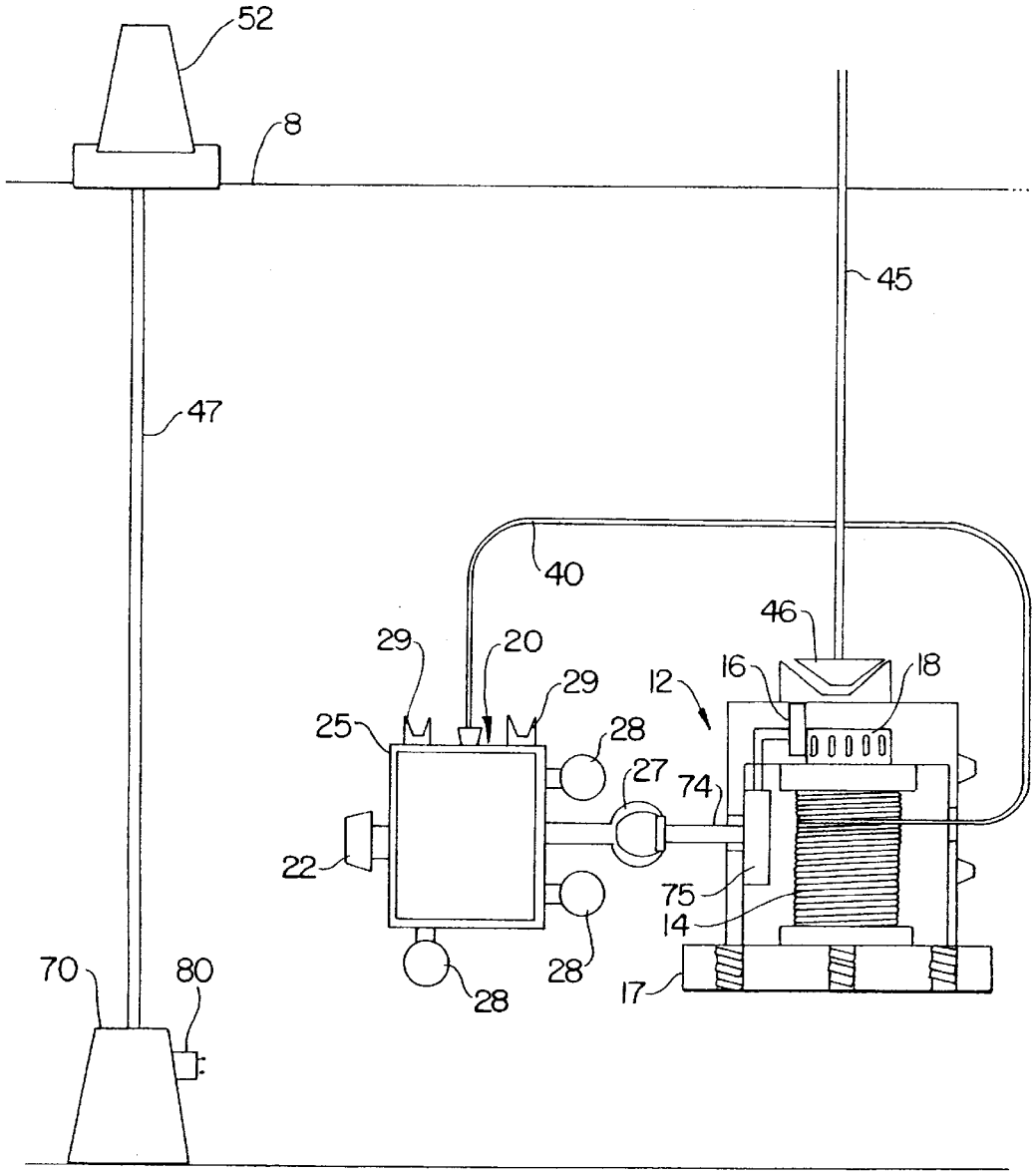
Figure 3D:
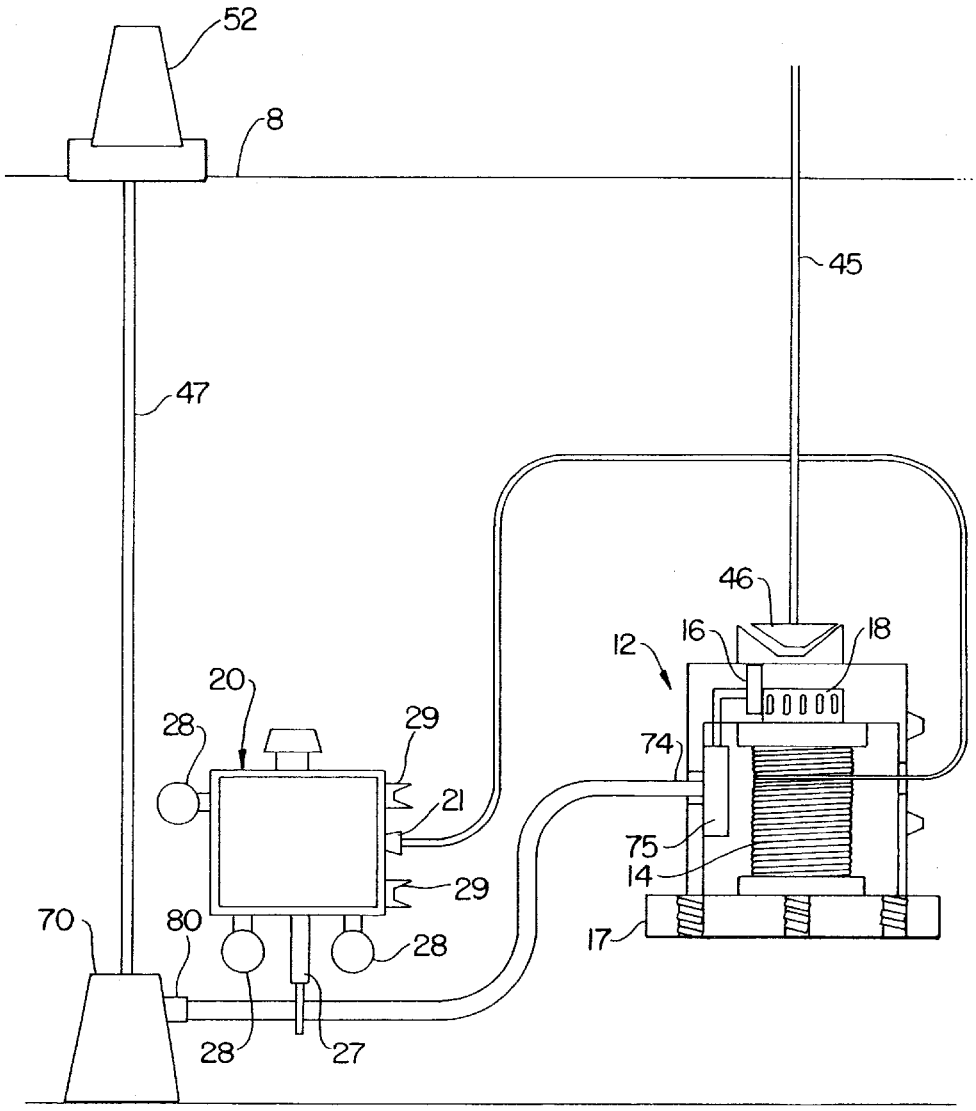

In FIG. 3B, tether management system 12 is shown suspended at a location just above the seabed (i.e., so that heave-induced motion will not cause system 12 to crash against the seabed). As shown in FIG. 3C, from this location, flying latch vehicle 20 then flies away from its docking point on tether management system 12 (i.e., linelatch system 10 is placed in the open configuration) to jumper cable 74 also on tether management system 12. Propulsion system 28 on flying latch vehicle 20 can be used to move vehicle 20 to facilitate this process. When positioned adjacent to jumper cable 74, manipulator 27 of flying latch vehicle 20 securely grasps the end of jumper cable 74 and gradually extends it from tether management system 12. As indicated in FIG. 3D, in the next step, vehicle 20 and manipulator 27 attach jumper cable 74 to subsurface module 70 by connecting the end of jumper cable 74 into power and data connection 80 (a power and data output socket) on module 70. This step permits power and data to be transferred from module 70 to linelatch system 10.

Figure 3E:
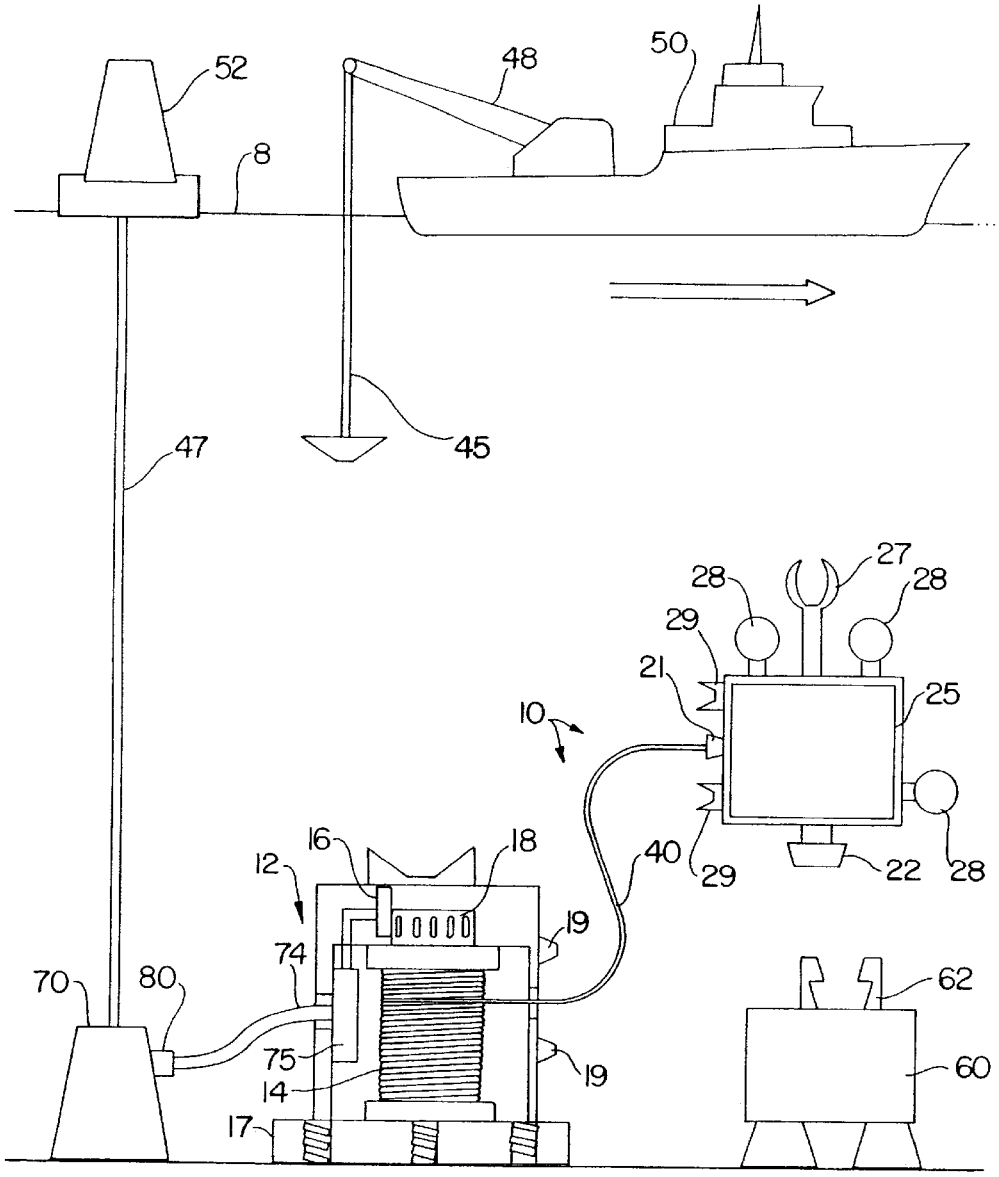

At this point umbilical 45 is no longer needed to supply power to linelatch system 12, so it can disconnect system 1 2 and be recovered to surface vessel 50. With the umbilical disconnected from tether management system 12, linelatch system 10 is no longer subject to any heave-induced motion transmitted through umbilical 45. Therefore, as shown in FIG. 3E, tether management system can then be positioned on the seabed by, for example, by dropping after being released from umbilical 45. Shock absorber 17 on the bottom of tether management system 12 can cushion the impact of system 12 landing on the seabed.

Figure 3F:
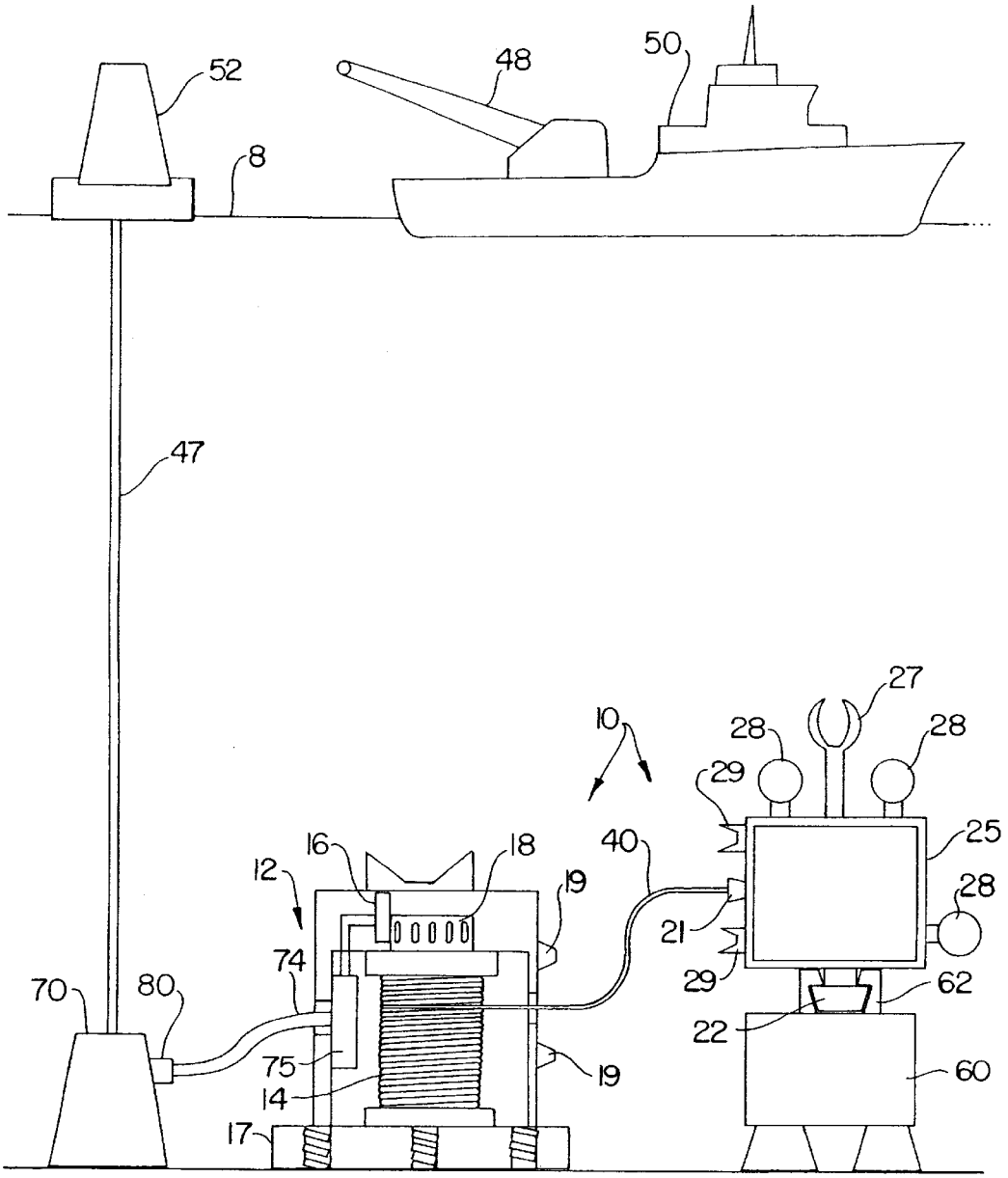

As shown in FIG. 3E, flying latch vehicle 20 then flies (e.g., using power derived from module 70 to operate propulsion system 28) to a location near subsurface device 60. After proper alignment of flying latch vehicle 20 with subsurface device 60, vehicle 20 is moved (e.g., using propulsion system 28) a short distance toward device 60 so that connector 22 securely engages (i.e., docks) receptor 62. FIG. 3F shows flying latch vehicle 20 physically engaging (i.e., docking) subsurface device 60. In this manner, power and data can be transferred between module 70 and device 60. For example, where module 70 is connected to a surface structure such as surface platform 52 (see FIG. 1A for example), the power and data bridge between module 70 and device 60 made by linelatch system 10 allows subsurface device 60 to be remotely operated by a pilot located on the surface structure via module pipe 47.

In a variation of the foregoing, umbilical 45 is not required as a power or data conduit. Rather, linelatch system 10 can be deployed and recovered from the sea bed using a simple lift line such as a cable, and an on board power means and preprogrammed position control system on linelatch system 10 used to fly vehicle 20 so that it can attach jumper cable 74 to module 70 (thereby providing power to linelatch system 10 from an external source). In addition to the foregoing, several other variations on the use of linelatch system 10 are within the invention. For example, two or more linelatch systems 1 0 can be lowered to subsurface locations to link several underwater devices 60 and/or modules 70 and/or vessels 50 to create a network of power and data connections for operating the underwater devices 60.

Figure 4:
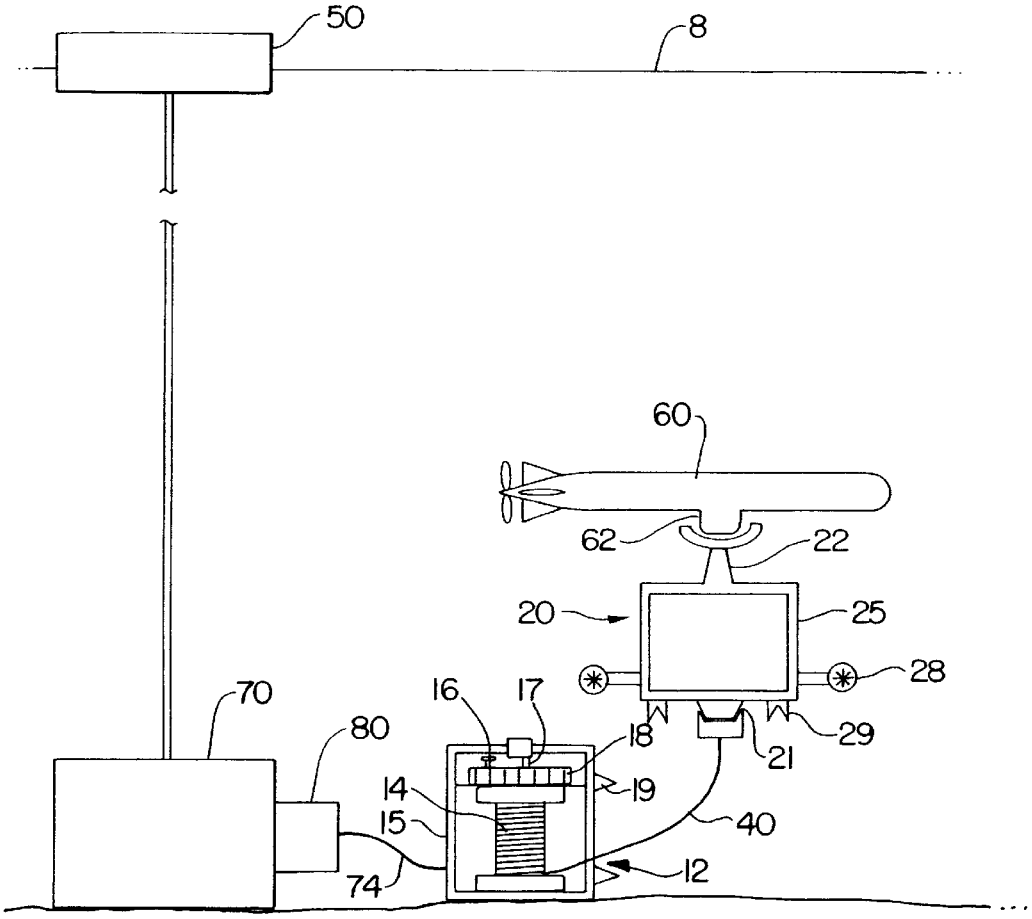
FIG. 4 is a schematic view of an underwater operation performed by a linelatch system of the invention.

Referring now to FIG. 4, linelatch system 10 can also be used to service (e.g., transfer power and/or data between) an underwater device (e.g., subsurface module 70) and a underwater vehicle (e.g., an AUV or a submarine) such as subsurface craft 90. In this method, linelatch system 10 serves as a power and communications bridge (as well as a mechanical link) between surface support vessel 50 and craft 90. In preferred embodiments, this method includes the steps of deploying linelatch system 10 from surface vessel 50 into body of water 8; placing linelatch system 10 in the open position; connecting jumper cable 74 to module 70, maneuvering flying latch vehicle 20 to craft 90; aligning and mating vehicle 20 with craft 90; transferring power and/or data between module 70 and craft 90 (via flying latch vehicle 20), and undocking vehicle 20 from craft 90.

As shown in FIG. 4, linelatch system 10 can be lowered to a subsurface location to interface, provide power to, and exchange data with craft 90 at a subsurface (shown). Similarly to the operation shown in FIGS. 3A–3E, linelatch system 10 is lowered by umbilical 45 from surface support vehicle 50 using launching and recovery device 48. Linelatch system 10 is lowered until it reaches a location just above the seabed. Flying latch vehicle 20 then flies away from its attachment point on tether management system 12 to jumper cable 74 also on tether management system 12. When positioned adjacent to jumper cable 74, manipulator 27 of flying latch vehicle 20 securely grasps the end of jumper cable 74 and gradually extends it from tether management system 12. Vehicle 20 and manipulator 27 then attach jumper cable 74 to subsurface module 70 by connecting the end of subsurface module 70 into power and data connection 80. This step transfers power and data from module 70 to linelatch system 10. Umbilical 45 then disconnects tether management system 12, which is then positioned on the seabed. Flying latch vehicle 20 then flies to and then docks with craft 90.

Linelatch system 10 thereby physically connects craft 90 and module 70. Through this connection, power and data can be transferred between module 70 and craft 90. The power thus transferred to craft 90 can be used to recharge a power source (e.g., a battery) on craft 90 or run the power-consuming components of craft 90 independent of its on-board power supply. In a like fashion, data recorded from craft 90's previous mission can be uploaded to module 70 and new mission instructions downloaded to craft 90 from module 70. Using this method, craft 90 can be repeatedly serviced so that it can perform several missions in a row without having to surface.

Myriad variations on the foregoing methods can be made for interfacing subsurface devices. For example, rather than using a subsurface power supply (e.g., module 70), power can be supplied for these methods from an underwater vehicle such as a submarine. From the foregoing, it can be appreciated that the linelatch system of the invention facilitates many undersea operations.

While the above specification contains many specifics, these should not be construed as limitations on the scope of the invention, but rather as examples of preferred embodiments thereof. Many other variations are possible. For example, a manned linelatch system and undersea vehicles having a linelatch system incorporated therein are included within the invention. Accordingly, the scope of the invention should be determined not by the embodiments illustrated, but by the appended claims and their legal equivalents.

What is claimed is:

1. A submersible system for transferring power from a subsurface power supply module to a subsurface device, comprising:

a tether management system having an umbilical connector configured for deploying said tether management system from a surface vessel to a seabed, a jumper cable extendible from said tether management system configured for receiving at least one of power and data from an external subsurface module;

a submersible vehicle releasably docked to said tether management system, said submersible vehicle having a tether receiving at least one of data and power from said tether management system a transfer system for selectively transferring at least one of said data and power to said submersible vehicle from said external subsurface module and said umbilical connector.

2. The submersible system according to claim 1 wherein said submersible vehicle is self-propelled to move between said tether management system and a subsurface device.

3. The submersible system according to claim 2 wherein said submersible vehicle has a vehicle connector which automatically engages a corresponding mating connector on said subsurface device when said submersible vehicle is propelled to a mating position adjacent to said subsurface device.

4. The submersible system according to claim 3 wherein said vehicle connector is a power connector and about 50% and 100% of the power received by said submersible vehicle from said transfer system is transferred to said subsurface device.

5. The submersible system according to claim 4 wherein said submersible vehicle is operable for extending said jumper cable from said tether management system to said subsurface module to form at least one of a data and power connection between said subsurface module and said tether management system.

6. The submersible system according to claim 2, further comprising means for automatically remotely detaching said umbilical connector from an umbilical cable in response to a control command.

7. The submersible system according to claim 1, further comprising a power supply integrated within at least one of said tether management system and said submersible vehicle for powering the submersible vehicle.

8. The submersible system according to claim 6 further comprising a shock absorber system on a lower portion of said tether management system for absorbing impact with a seabed resulting from positioning said submersible system.

9. A method for establishing a power and control connection from a subsurface power supply module to a subsurface device, comprising the steps of:

deploying a tether management system to a subsea location;

in response to a control command, extending a jumper cable from said tether management system to said subsurface power supply module for transferring at least one of data and power from said subsurface power supply module to said tether management system; and flying a power connector from said tether management system to said subsurface device to establish at least one of a power and data transfer circuit between said tether management system and said subsurface device.

10. The method according to claim 9 wherein said deploying step further includes the step of lowering said tether management system to said subsea location using a cable, and subsequently detaching the cable from said tether management system.

11. The method according to claim 10 wherein said cable is an umbilical cable and provides at least one of data, power and materials to said tether management system.

12. The method according to claim 10 wherein said detaching step is performed before said extending step.

13. The method according to claim 10 wherein said detaching step is performed after said extending step.

14. A method of deploying a submersible system and connecting the submersible system to an subsurface module, said method comprising the steps of:

deploying a submersible system to the bottom of a body of water, the submersible system including:

a tether management system having a cable for receiving at least one of data, power, and material from the subsurface module, a submersible vehicle detachably connected to the tether management system, and a tether attaching the submersible vehicle to the tether management system;

detaching the submersible vehicle from the tether management system; and, connecting the cable to the subsurface module.

15. The method as recited in claim 14, wherein said deploying step further includes the step of lowering the submersible system with a cable from a vessel to the bottom, and subsequently detaching the cable from the submersible system.

16. The method as recited in claim 15, further comprising the step of powering the submersible vehicle from a power source in the submersible system before said detaching step.

17. The method as recited in claim 16, wherein before said detaching step, said connecting step further includes the steps of:

maneuvering the submersible vehicle to the cable, retrieving the cable with the submersible vehicle, and maneuvering the submersible vehicle and cable to the subsurface module.

18. The method as recited in claim 15, further comprising the step of powering the submersible vehicle from the cable before said detaching step.

19. The method as recited in claim 18, wherein before said detaching step, said connecting step further includes the steps of:

maneuvering the submersible vehicle to the cable, retrieving the cable with the submersible vehicle, and maneuvering the submersible vehicle and cable to the subsurface module.

* * * * *